US008424117B2

(12) United States Patent
Hasan et al.

(10) Patent No.: US 8,424,117 B2
(45) Date of Patent: Apr. 23, 2013

(54) GARMENT INCLUDING ANKLE CUSHION AND METHOD OF MAKING SAME

(75) Inventors: Anwar Ricky Hasan, Troy, NY (US); Christian Arakelian, Troy, NY (US)

(73) Assignee: Achilles Comfort, LLC, Boca Raton, FL (US)

( * ) Notice: Subject to any disclaimer, the term of this patent is extended or adjusted under 35 U.S.C. 154(b) by 82 days.

(21) Appl. No.: 12/612,229

(22) Filed: Nov. 4, 2009

(65) Prior Publication Data

US 2010/0043124 A1 Feb. 25, 2010

Related U.S. Application Data

(63) Continuation-in-part of application No. 12/368,769, filed on Feb. 10, 2009, now abandoned.

(60) Provisional application No. 61/130,580, filed on Jun. 2, 2008.

(51) Int. Cl.
*A41B 11/00* (2006.01)

(52) U.S. Cl.
USPC ..... 2/239

(58) Field of Classification Search ..... 2/61, 239, 2/240, 241, 242, 409, 267; 36/58.5, 71, 72 B, 36/59 R; 428/41.8
See application file for complete search history.

(56) References Cited

U.S. PATENT DOCUMENTS 2,275,191 A * 3/1942 Schwartz et al. ..... 36/58.5
2,617,992 A 11/1952 Bean
3,039,907 A 6/1962 Scholl
4,069,600 A 1/1978 Wise
4,266,298 A 5/1981 Graziano
4,296,499 A 10/1981 Patterson et al.

(Continued)

FOREIGN PATENT DOCUMENTS

CN 201243623 5/2009
CN 201267187 7/2009
EP 1897456 3/2008
FR 2808661 11/2001

OTHER PUBLICATIONS

International Search Report & Written Opinion dated Jan. 11, 2011; PCT/US2010/055034, Int'l File Date: Nov. 2, 2010 in the name of Achilles Comfort, LLC.

(Continued)

*Primary Examiner* — Khoa Huynh
*Assistant Examiner* — Anna Kinsaul
(74) *Attorney, Agent, or Firm* — Schmeiser, Olsen & Watts, LLP

(57) ABSTRACT

A hosiery garment is provided including a main body adapted to enclose at least a foot of a wearer, the main body having an outside and an inside, wherein the inside is configured to be in contact with the foot of the wearer. The hosiery garment includes a multi-layered cushion, the multi-layered cushion comprising an adhesive layer configured to adhere the multi-layered cushion to the inside of the main body, a synthetic rubber layer adhered to the adhesive layer, and a fabric layer adhered to the synthetic rubber layer and configured to be in contact with the foot of the wearer. Furthermore, the multi-layered cushion wraps partially around a back side of an ankle portion of the hosiery garment such that the multi-layered cushion protects an Achilles heel of the wearer from abrasion caused by a heel of a footwear.

15 Claims, 10 Drawing Sheets

U.S. PATENT DOCUMENTS

| | | | | | |
|---|---|---|---|---|---|
| 4,622,089 | A | | 11/1986 | Lauritzen | |
| 4,631,755 | A | | 12/1986 | Zingg et al. | |
| 5,092,347 | A | * | 3/1992 | Shaffer et al. | 128/892 |
| 5,133,088 | A | | 7/1992 | Dunlap | |
| 5,135,473 | A | | 8/1992 | Epler et al. | |
| 5,185,000 | A | * | 2/1993 | Brandt et al. | 602/63 |
| 5,307,522 | A | * | 5/1994 | Throneburg et al. | 2/239 |
| 5,539,020 | A | | 7/1996 | Bracken et al. | |
| 5,617,745 | A | * | 4/1997 | Della Corte et al. | 66/178 A |
| 5,637,368 | A | * | 6/1997 | Cadalbert et al. | 428/40.1 |
| 5,645,525 | A | | 7/1997 | Krivosha | |
| 5,768,713 | A | | 6/1998 | Crick | |
| 5,771,495 | A | | 6/1998 | Turner et al. | |
| 5,799,416 | A | | 9/1998 | Prober | |
| 5,823,195 | A | * | 10/1998 | Shook et al. | 128/893 |
| 5,842,292 | A | | 12/1998 | Siesel | |
| 6,187,837 | B1 | * | 2/2001 | Pearce | 523/105 |
| 6,270,872 | B1 | | 8/2001 | Cline et al. | |
| 6,378,138 | B1 | | 4/2002 | Ridgley et al. | |
| 6,589,630 | B1 | | 7/2003 | Crow | |
| 7,192,411 | B2 | | 3/2007 | Gobet et al. | |
| 7,346,936 | B2 | | 3/2008 | Vargas et al. | |
| 7,434,336 | B2 | | 10/2008 | Kosted | |
| 7,441,419 | B1 | | 10/2008 | Dollyhite et al. | |
| 2003/0167548 | A1 | | 9/2003 | LaShoto et al. | |
| 2007/0033710 | A1 | | 2/2007 | Lambertz | |
| 2007/0118973 | A1 | | 5/2007 | Lambertz | |
| 2007/0271680 | A1 | | 11/2007 | Howell et al. | |
| 2008/0209616 | A1 | | 9/2008 | Manning et al. | |
| 2009/0113602 | A1 | | 5/2009 | Lambertz | |
| 2009/0211585 | A1 | | 8/2009 | Cumbie et al. | |
| 2009/0293179 | A1 | * | 12/2009 | Hasan | 2/409 |
| 2010/0287689 | A1 | * | 11/2010 | Sullivan | 2/458 |
| 2011/0296588 | A1 | * | 12/2011 | Cummings | 2/239 |

OTHER PUBLICATIONS

Dr. Scholl's Suede Heel Grips. [online]. 1 page. [retrieved on Feb. 10, 2009]. Retrieved from the Internet:< URL: http://www.amazon.com/Dr-Scholls-Suede-Grips-Womens/dp/B000053L5N>.

Heel Grips "Pump Bumps." [online]. 1 page. [retrieved on Feb. 10, 2009]. Retrieved from the Internet:< URL: http://www.hapad.com/hapadpro/grip.shtml>.

SofSole Anti-Slip Heel Grips. [online]. 1 page. [retrieved on Feb. 10, 2009]. Retrieved from the Internet:< URL: http://www.softmoc.com/us/systemshow-item_IHEEL%20GRIPS>.

Heavenly Huggers Heel Grips. [online]. 1 page. [retrieved on Feb. 10, 2009]. Retrieved from the Internet:< URL: http://shoptions.net/products.php?q=Heel+Grips>.

Shoe Inserts: Heel Grip #90006. [online]. 1 page. [retrieved on Feb. 10, 2009]. Retrieved from the Internet:< URL: http://www.foot-comfort.com/heelgrips90006.htm>.

Sure Comfort Heel Grips. [online]. 1 page. [retrieved on Feb. 10, 2009]. Retrieved from the Internet:< URL: http://www.shoestuff.com/Sure_Comfort-Heel_Grips.html>.

Clear Invisigel Heel Hugger Grips. [online]. 1 page. [retrieved on Feb. 10, 2009]. Retrieved from the Internet:< URL: http://www.footcareonline.co.uk/heel_grips.htm>.

Tacco Slip Heel Grips. [online]. 1 page. [retrieved on Feb. 10, 2009]. Retrieved from the Internet< URL: http://www.shoeshinekit.com/heelgrips.html>.

Band-Aid Blister Block. [online]. 1 page. [retrieved on Feb. 10, 2009]. Retrieved from the Internet:< URL: http://www.medshopexpress.com/127931.html>.

Atwater Carey Moleskin. [online]. 1 page. [retrieved on Feb. 10, 2009]. Retrieved from the Internet:< URL: http://www.efunctional.com/ps292.html>.

Band-Aid Brand Cushions for Feet. [online]. 1 page. [retrieved on Feb. 10, 2009]. Retrieved from the Internet:< URL: http://www.safety-products.com/p-686-band-aid-brand-advanced-healing-bandages.aspx>.

* cited by examiner

GARMENT INCLUDING ANKLE CUSHION AND METHOD OF MAKING SAME

RELATED APPLICATION

This application is a continuation-in-part of parent patent application No. 12/368,769 filed Feb. 10, 2009, entitled GARMENT INCLUDING ANKLE CUSHION AND METHOD OF MAKING SAME, the disclosure of which is herein incorporated by reference to the extent not inconsistent with the present disclosure. It should be noted that the parent application claims priority to a commonly owned U.S. Provisional Patent Application Ser. No. 61/130,580, filed Jun. 2, 2008, of Anwar Hasan, entitled 'STEP A.K.A. "ANKLE COMFORT" PADS.'

FIELD OF THE INVENTION

The subject matter disclosed herein relates generally to a garment to cover the ankle and a method of making the same. More particularly, the subject matter relates to an ankle comfort cushion that is adapted for the protection of the ankle from irritation caused by the heel of a shoe or the like.

BACKGROUND OF THE INVENTION

Garments coverings the legs and feet take various forms such as leggings, socks, stockings and tights and other hosiery. These garments serve several purposes such as keeping the feet warm, providing comfort to the wearer, keeping the feet clean, and providing style or fashion. Additionally, these garments often help to absorb the sweat in the foot and draw it to areas where it can be evaporated. In cold environments, garments such as socks help to retain heat while removing moisture, thereby helping to prevent frostbite. Furthermore, hosiery may help to ease chafing and irritation between the foot and footwear. Particular types of footwear such as dress shoes, hockey skates, ski boots, athletic footwear and high heeled shows often cause irritation to the wearer where the heel of the footwear digs in and rubs against the ankle, despite the use of these garments. This is also a major concern when a wearer uses new footwear that is stiff and yet to be broken in.

Thus, a garment that reduces the chafing, irritation or cutting of the skin caused by the heel of footwear would be well received in the art.

BRIEF DESCRIPTION OF THE INVENTION

According to one aspect of the invention, a hosiery garment is comprises a main body adapted to enclose at least a foot of a wearer, the main body having an outside and an inside, wherein the inside is configured to be in contact with the foot of the wearer. The hosiery garment includes a multi-layered cushion, the multi-layered cushion comprising an adhesive layer configured to adhere the multi-layered cushion to the inside of the main body, a synthetic rubber layer adhered to the adhesive layer, and a fabric layer adhered to the synthetic rubber layer and configured to be in contact with the foot of the wearer. Furthermore, the multi-layered cushion wraps partially around a back side of an ankle portion of the hosiery garment such that the multi-layered cushion protects an Achilles heel of the wearer from abrasion caused by a heel of a footwear.

According to another aspect of the invention, a method of making a hosiery garment comprises adhering a synthetic rubber layer to an adhesive layer, adhering a fabric layer to the synthetic rubber layer to create a multi-layer cushion having the synthetic rubber layer located between the adhesive layer and the fabric layer, and adhering the adhesive layer to an inside of a garment adapted to enclose at least a foot of a wearer, wherein the inside is configured to be in contact with the foot of the wearer, and wherein the multi-layered cushion wraps partially around a back side of an ankle portion of the hosiery garment such that the multi-layered cushion protects an Achilles heel of the wearer from abrasion caused by a heel of a footwear.

According to yet another aspect of the invention, a hosiery garment comprises a multi-layered cushion. The multi-layered cushion comprises an adhesive transfer tape layer adhering the multi-layered cushion to the interior surface of the hosiery garment; a neoprene layer adhered to the adhesive layer; and a breathable polyester fabric layer adhered to the synthetic rubber layer and configured to be in contact with the foot of the wearer. Furthermore, the multi-layered cushion wraps partially around a back side of an ankle portion of the interior surface of the hosiery garment such that the multi-layered cushion protects an Achilles heel of the wearer from abrasion caused by a heel of a footwear.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION OF THE INVENTION

A detailed description of the hereinafter described embodiments of the disclosed apparatus and method are presented herein by way of exemplification and not limitation with reference to the Figures.

Figure 1:
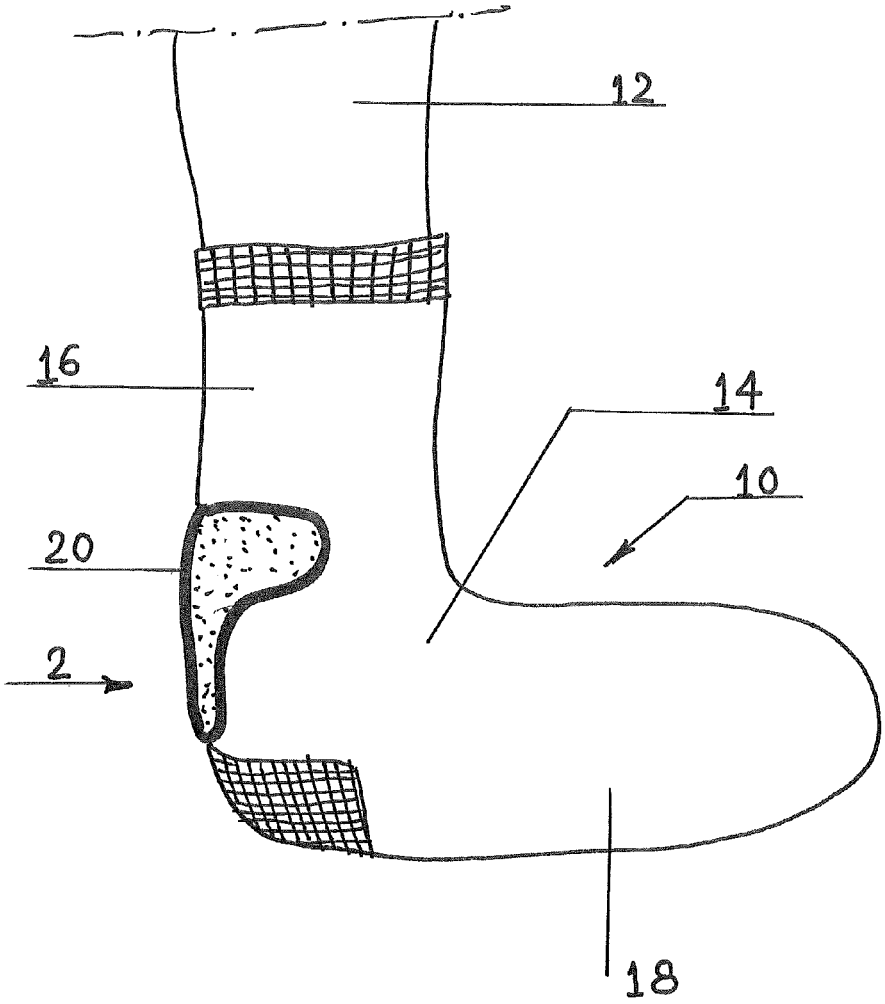
FIG. 1 depicts a perspective view of a sock being worn by a wearer and having a cushion in accordance with one embodiment of the present invention.
Figure 4:
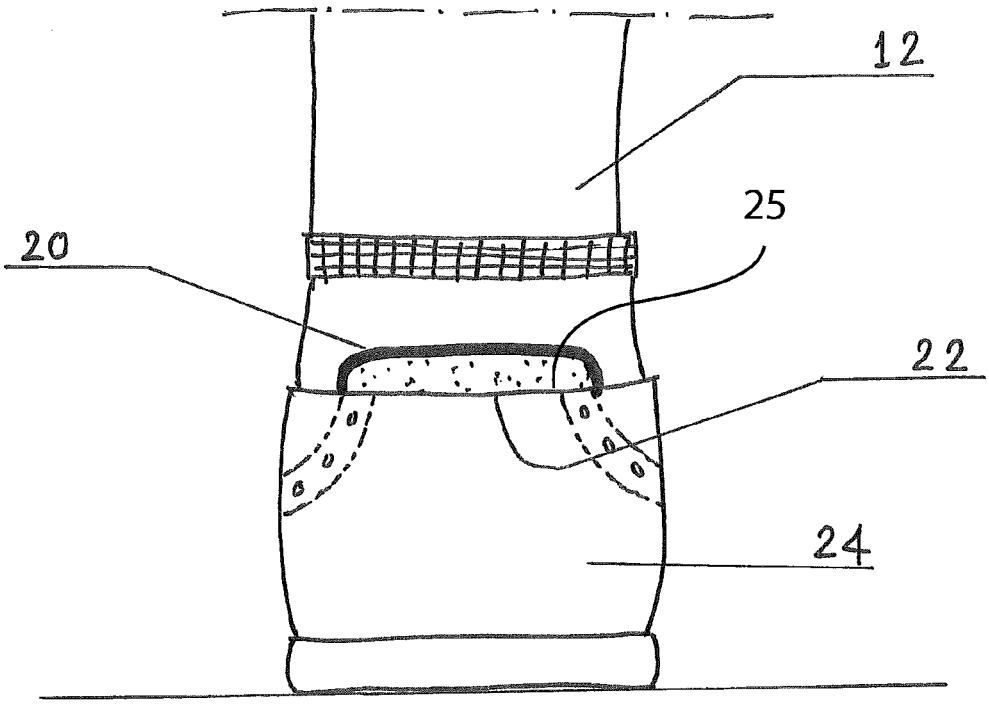
FIG. 4 depicts a perspective view of the sock of FIG. 1, being worn with a dress shoe by the wearer in accordance with one embodiment of the present invention.
Figure 5:
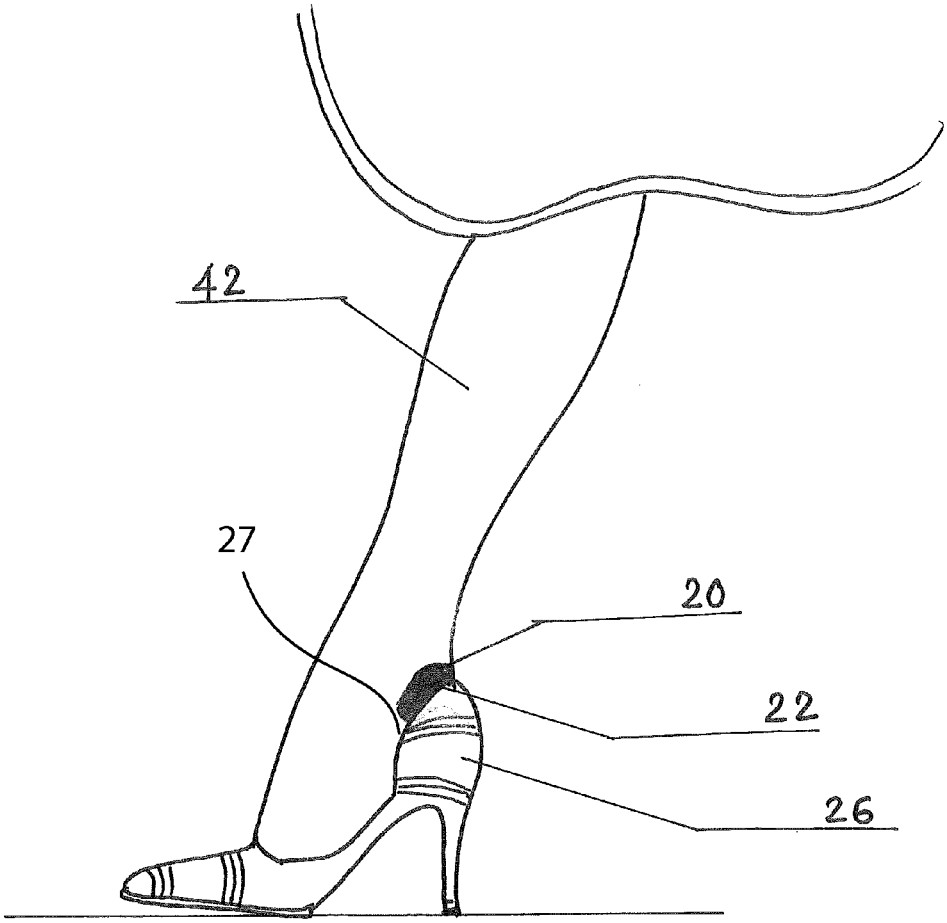
FIG. 5 depicts a perspective view of a stocking utilizing the cushion and being worn with a high heeled shoe on a leg of the wearer in accordance with another embodiment of the present invention.

Referring firstly to FIG. 1, there is shown a sock 10 in accordance with one embodiment of the present invention. The sock 10 is adapted to be worn over at least a foot of a wearer 12, as is generally known in the art. The sock 10 includes a main body 14, having both an ankle portion 16 and a foot portion 18. A cushion 20 is located at the ankle portion 16 of the main body 14, and extends partially about the ankle portion 16 of the sock 10. The cushion 20 is configured to protect the ankle or Achilles heel of the wearer 12 from abrasion and discomfort caused by impact with a heel 22 of a footwear 24, 26 (as is shown in FIGS. 4-5, described below). The cushion 20 provides additional thickness to the sock 10 at a location, such as the back of the ankle or at the Achilles heel, subjected to increased possibility of chafing, while at the same time allowing the sock 10 to retain an optimum thickness throughout the rest of the main body 14.

Figure 2:
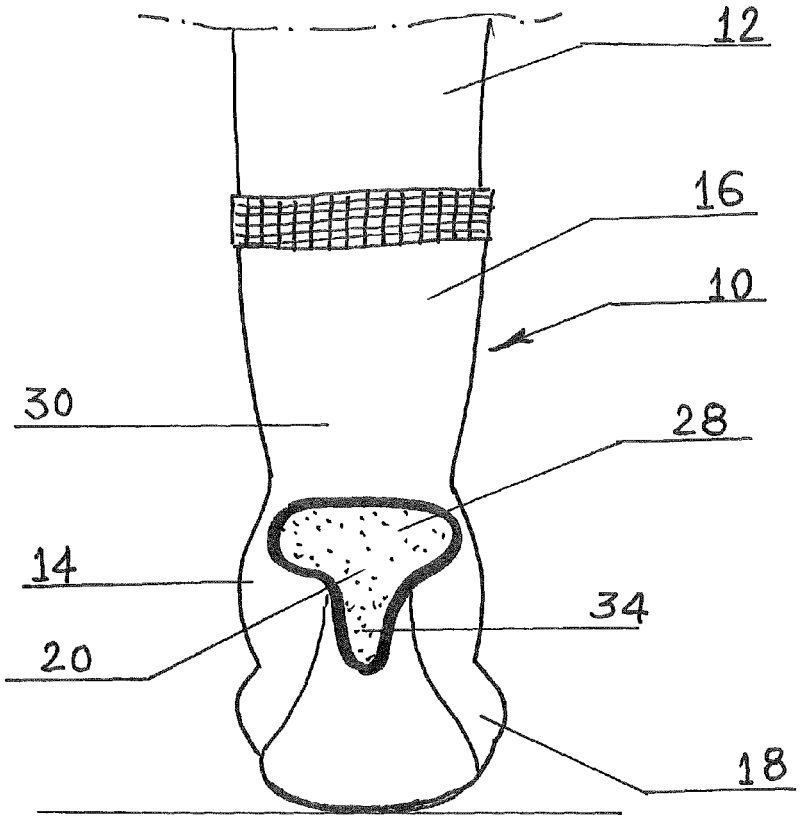
FIG. 2 depicts a perspective view of the sock of FIG. 1 being worn by the wearer, taken from arrow 2, in accordance with one embodiment of the present invention.

Turning to FIG. 2, a rear view of the sock 10 is shown being worn by the wearer 12, taken at arrow 2 of FIG. 1. The cushion 20 is shown having a horizontal body 28 wrapping partially around the ankle portion 16 from a rear side 30 of the sock 10. The horizontal body 28 helps to cushion an ankle 32 (shown in FIG. 3) of the wearer 12 at the height of the heel 22 of footwear 24, 26. Alternatively, the cushion may be referred to as a cushion, support or insulated portion. In one embodiment, the horizontal body 28 is between 2 and 5 inches in length. However, the horizontal body 28 may have any appropriate length. Further, the cushion is shown having a vertical lip 34 extending from the horizontal body 28 at least partially to a heel corner 36 of the sock 10. The vertical lip 34 further protects the ankle 32 of the wearer 12, and provides some leeway for heels 22 of footwear 24, 26 having different heights. In one embodiment, the vertical lip is between 1 and 3 inches in length. However, the vertical lip may have any length that would be appropriate. It should be understood that the shape of the cushion 20 is not limited to this "T" shaped embodiment, however. Further, the top of the "T", the horizontal body 28, may be angled in any manner that would be appropriate to protect from the intended footwear to be worn with the sock 10. Cushions having other shapes, such as ovular, triangular or other polygonal shapes are also contemplated.

Figure 3:
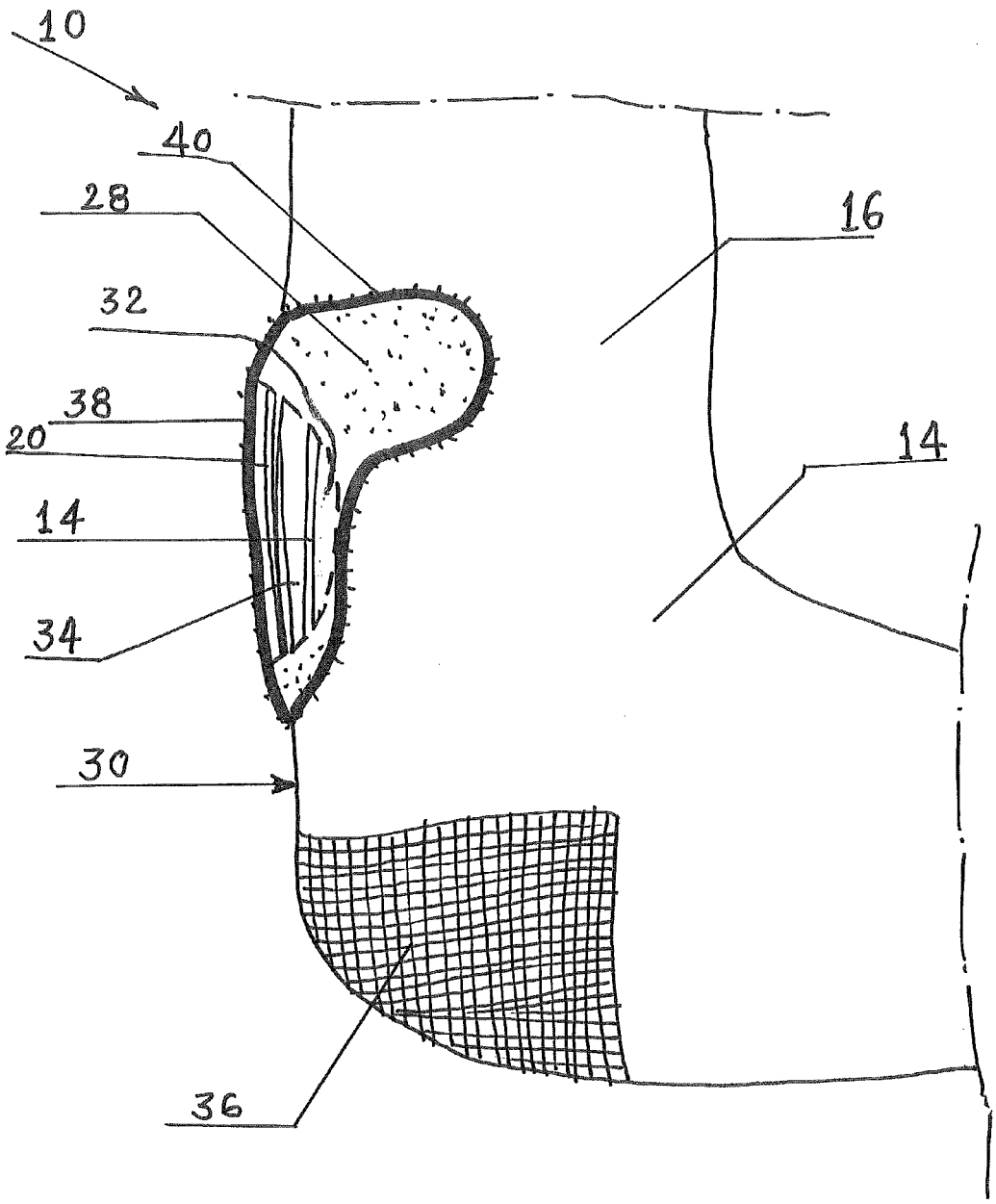
FIG. 3 depicts a cutaway view the cushion of the sock of FIG. 1, being worn by the wearer, in accordance with one embodiment of the present invention.

FIG. 3 depicts an exploded cutaway view the cushion 20 of the sock 10 of FIG. 1, being worn by the wearer 12. The cushion 20 is held in place between the main body 14 and a fabric layer 38 that is sewn into the main body 14 along a seam 40. In alternate embodiments, the cushion 20 may be adhered directly into the main body 14 of the sock 10 by sewing, tacking, riveting or any other feasible attachment means such as natural adhesives, synthetic adhesives, hook and loop fastener, drying adhesives, contact adhesives and hot or reactive adhesives. Furthermore, the cushion 20 may be made of cotton. It should be understood that the cushion 20 is not limited to cotton, however, and analogous materials would be apparent to those skilled in the art. For example, the cushion 20 may be made of foam, feathers, polyester, silk, air, linen, gel or other liquid, rubber, synthetic plastic, or water-proof breathable material such as Gore-tex® for wicking and removing moisture, which causes wear on the skin. Also, the cushion 20 may be a thicker ply of the same material as the sock 10, such as two or more times the thickness.

FIG. 4 depicts a perspective view of the sock 10, being worn with a dress shoe 24 by the wearer 12 in accordance with one embodiment of the present invention. Additionally, FIG. 5 depicts a perspective view of a stocking 42 having the cushion 20 and being worn with a high heeled shoe 26 by the wearer 12 in accordance with another embodiment of the present invention. In this case, the horizontal body 28 of the cushion 20 is angled downward along the body of the typical high heeled shoe to accommodate the fact that the wearer's foot is propped up by the heel of the shoe 26. As described hereinabove, any angle or shape of the cushion is contemplated by this invention. It should also be understood that the cushion 20 may be configured to protect the wearer 12 from abrasion caused by the heel 22 of any type of footwear. Thus, as shown in FIGS. 4 and 5, the cushion 20 may be designed to extend over at least a portion of a shoe line 25, 27 of the intended shoe 24, 26. In addition to the dress shoe 24 and the high heeled shoe 26, the cushion 20 may be configured to protect from abrasion from a casual shoe, boot, sneaker, tennis shoe, orthopedic shoe, basketball shoe, running shoe, ice skate, athletic cleat, ski boots, cross trainer shoes, sandals and flats. Additionally, it should be understood that the cushion 20 may be similarly applied to any form of hosiery in addition to the sock 10 and the stocking 42. For example, the cushion 20 may be applied to a dress sock, casual sock, legging, toe sock, tight, thigh-high sock, or athletic sock.

A further aspect of the present invention includes a method of producing a garment 10 comprising attaching the cushion 20 to the ankle portion 16 of the garment 10, wherein the cushion 20 is configured to protect the ankle 32 of the wearer 12 of the garment 10 from abrasion caused by the heel 22 of footwear 24, 26. The sewing may further comprise introducing the cushion 20 to the ankle portion 16 of the garment 10 and sewing, attaching or adhering the cushion 20 to the ankle portion 16 around the cushion 20. Alternately, the method may further comprise introducing the cushion 20 to the ankle portion 16 of the garment 10 and sewing the fabric layer 38 to the ankle portion 16 around the cushion 20.

Figure 6:
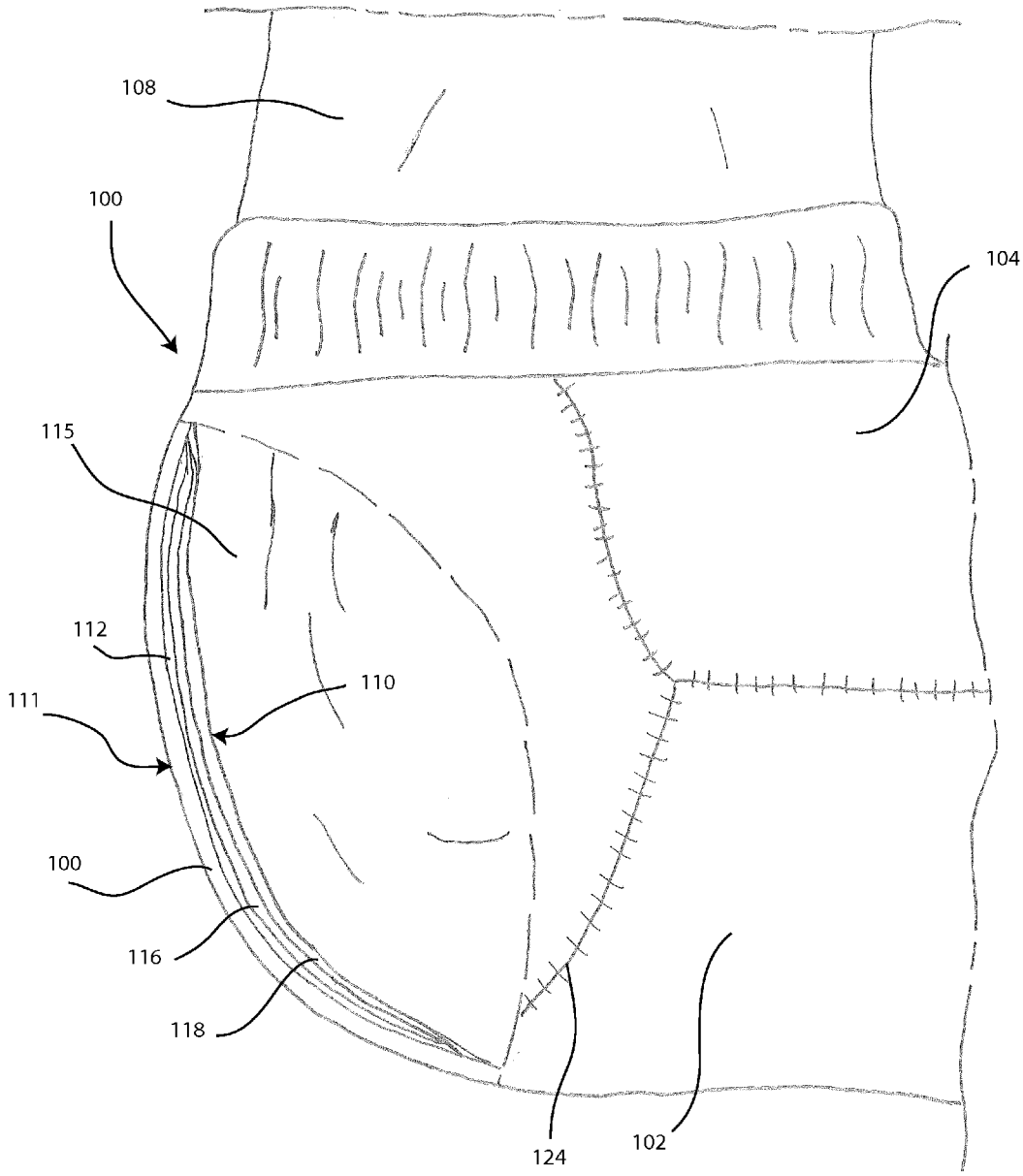
FIG. 6 depicts a cutaway view of a sock being worn by a wearer, in accordance with another embodiment of the present invention.
Figure 7:
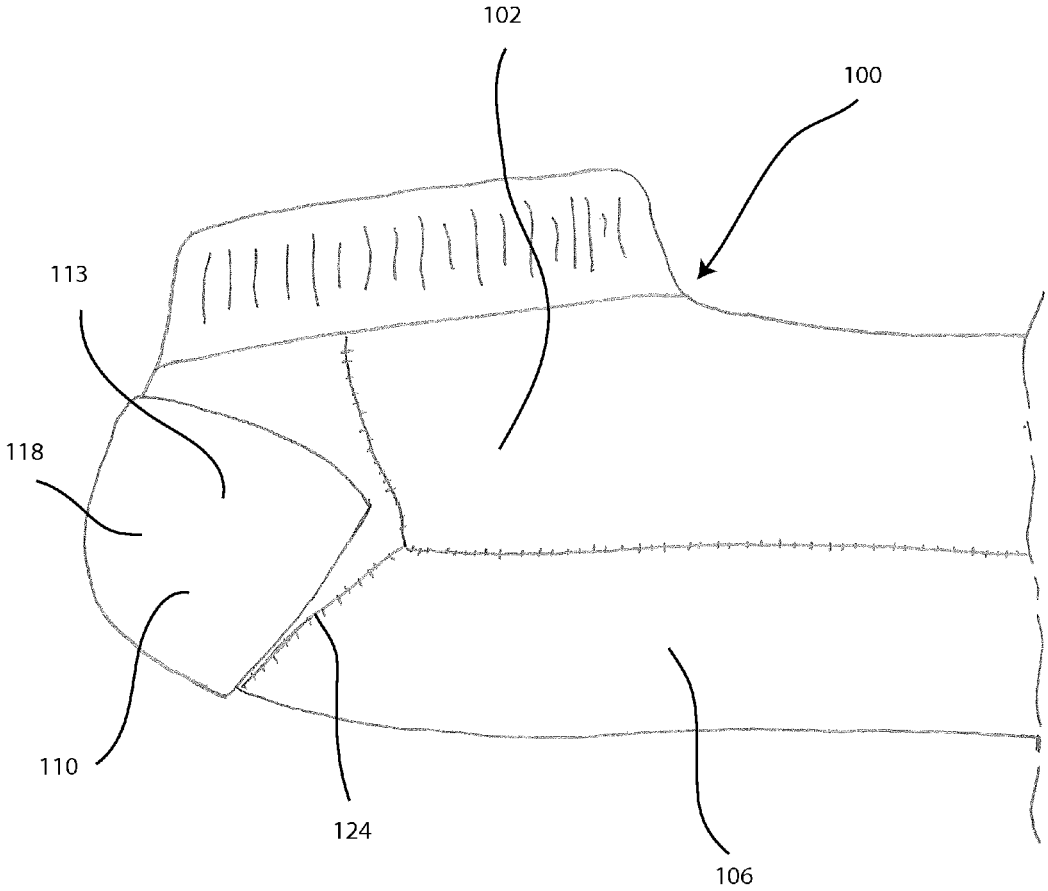
FIG. 7 depicts a side view of an inside surface of the sock of FIG. 6, in accordance with the present invention.
Figure 8:
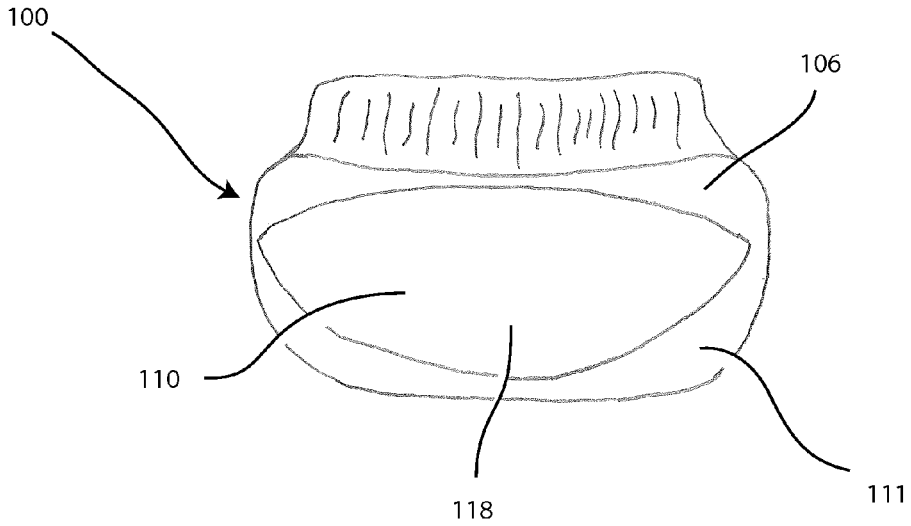
FIG. 8 depicts a rear view of an inside surface of the sock of FIGS. 6 and 7, in accordance with the present invention.

Referring now to FIGS. 6-9, a sock 100 is shown in accordance with another embodiment of the present invention. The sock 100 includes a main body 102 that is adapted to enclose at least the foot of a wearer. The main body 102 includes an outside 104 and an inside 106, with the inside 106 being configured to contact the foot of a wearer 108. FIG. 6 shows a cutaway view of the outside 104 of the sock 100 while FIGS. 7 and 8 show perspective views of the sock 100 after being turned inside-out, thereby exposing the inside 106. The outside 104 and the inside 106 may include different stitching and textures as is commonly known in the art. For example, the outside 104 may be more resilient to wear and more aesthetically appealing. This is because the outside 104 is generally exposed while being worn, as will be understood by those skilled in the art. In contrast, the inside 106 may include stitch protrusions at seams. Furthermore, the inside 106 may have a softer stitching so that the sock 100 is smoother to the skin of the wearer 108. While the embodiment shown in FIGS. 6-8 depicts the sock 100, it should be understood that the present invention may be applied to a dress sock, casual sock, stocking, legging, toe sock, tights, thigh-high sock, athletic sock or the like. Those skilled in the art will understand that these alternate forms of hosiery garments each include an interior and exterior surface similar to the inside 106 and the outside 104 of the sock 100.

Figure 9:
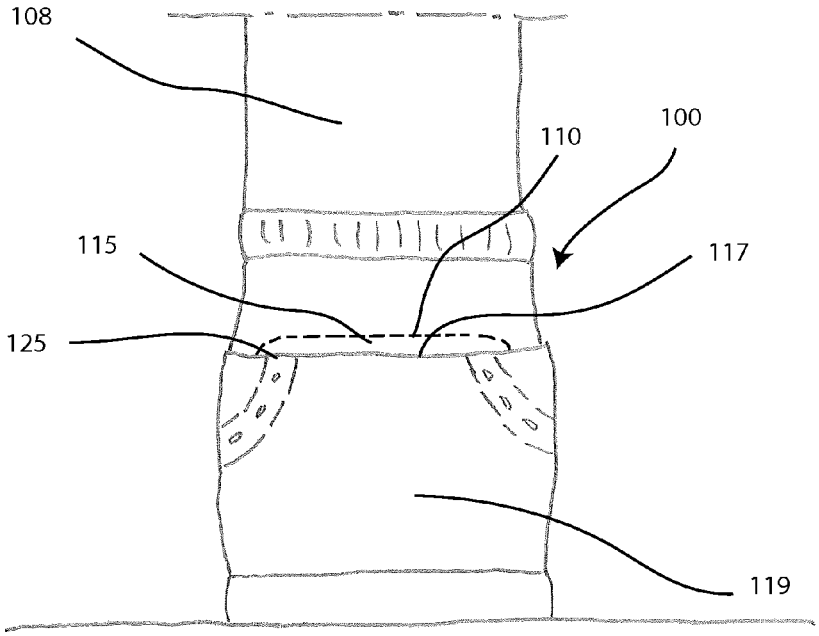
FIG. 9 depicts a rear view of the sock of FIGS. 6-8 being worn by a wearer with a shoe.
Figure 10:
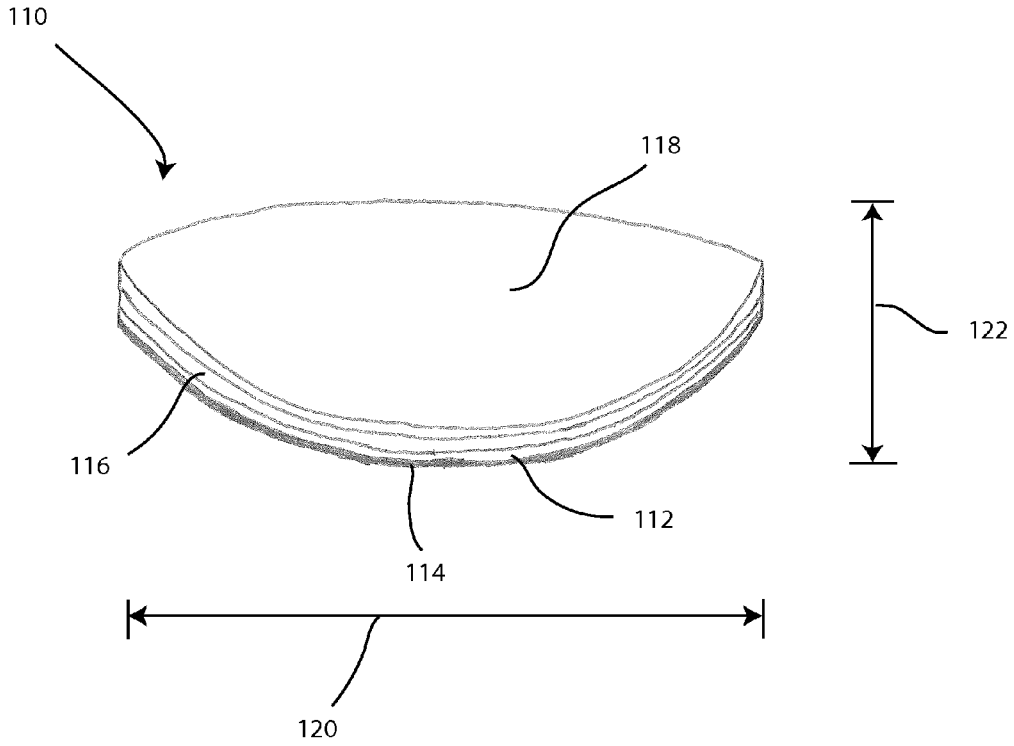
FIG. 10 depicts a multi-layered cushion prior to being applied to a hosiery garment, in accordance with another embodiment of the present invention.

The sock 100 further includes a multi-layered cushion 110 attached to the inside 106. While FIGS. 6-9 show the sock after attachment of the multi-layered cushion 110, FIG. 10 shows the multi-layered cushion 110 prior to attachment. The multi-layered cushion may wrap partially around a back side 111 of an ankle portion 113 of the sock 100 or other hosiery garment such that the multi-layered cushion 110 protects an Achilles heel 115 of the wearer 108 from abrasion caused by a heel 117 of footwear such as the shoe 119. FIG. 9 shows a rear view of the sock 100 being worn with the shoe 119 by a wearer 108. The sock 100 or other hosiery garment may be configured to have the multi-layered cushion at a particular location to protect the Achilles heel 115 of the wearer 108 from abrasion caused by a heel of other types of footwear (not shown) such as dress shoes, casual shoes, high heeled shoes, boots, sneakers, tennis shoes, orthopedic shoes, basketball shoes, running shoes, ice skates, athletic cleats, ski boots, cross trainer shoes, sandals, and flats. Thus, as shown in FIG. 9, the cushion 110 (shown in phantom) may be designed to extend over at least a portion of a shoe line 125 of the intended shoe 119. For example, if the intended footwear to be worn with the sock 100 has a high heel (such as with a ski boot or hockey skate), the multi-layered cushion 110 may be applied to the sock at a higher location than the shoe line 125 and may have a larger cushion with a larger vertical length 122 extending from the heel.

For the purposes of orientation in the description of the multi-layered cushion 110 herein, the term "bottom" will be used to describe the side of the multi-layered cushion 110 that is proximal and attached to the sock 100 or other hosiery garment. Likewise, the term "top" will be used to describe the side of the multi-layered cushion 110 that is distal to the attached sock 100 or other hosiery garment and that is proximal to the foot of the wearer 108.

The multi-layered cushion 110 includes an adhesive layer 112 on the bottom side that is configured to adhere to the inside 106 of the sock 100. Adhering the multi-layered cushion 110 to the inside 106 of the sock 100 may be particularly important for protecting the multi-layered cushion 110, by the fabric of the sock 100 or other hosiery garment. Attaching the multi-layered cushion 110 to the inside 106 of the sock 100 may further prevent the multi-layered cushion 110 from experiencing wear from the friction between the sock 100 or other hosiery garment and the shoe 119 or other footwear being worn by the wearer 108. Furthermore, attachment to the interior 106 may enhance the aesthetics of the exterior 104 of the sock 100 or other hosiery garment because the multi-layered cushion 110 will be hidden when viewed by an observer. Furthermore, it may allow the shoe 119 or other footwear to be more easily slipped into by the wearer 108 without undesirably bunching the sock 100 or other hosiery garment.

The adhesive layer 112 may further be a highly adhesive transfer tape having a temperature resistance of at least 200 degrees Fahrenheit. This high temperature resistance property may allow the adhesive layer to not melt during a drying process that the sock 100 or other hosiery garment may be exposed to. The adhesive layer may also include a peelable protective layer 114 on the bottom side prior to being adhered to the inside 106 of the main body 102 of the sock 100 or other hosiery garment. The peelable protective layer 114 may be peeled just prior to the moment the adhesive layer 112 of the multi-layered cushion 110 is to be adhered to the sock 100 or other hosiery garment. The peelable protective layer 114 may be particularly advantageous during the manufacturing process because it may allow the multi-layered cushion 110 to be assembled in a separate location than where it is adhered to the inside 106 of the sock 100 or other hosiery garment.

The multi-layered cushion 110 further includes a synthetic rubber layer 116 adhered to the adhesive layer 112. The synthetic rubber layer 116 may be die cut to the correct shape during a manufacturing process of the multi-layered cushion 110. The synthetic rubber layer 116 may provide the majority of the cushioning quality of the multi-layered cushion 110. The synthetic rubber layer 116 may be made of a neoprene material having a temperature resistance of at least 200 degrees Fahrenheit. Neoprene may be particularly advantageous for this application because it is washable and resistant to high temperatures that the sock 100 or other hosiery garment may be exposed to during drying. Furthermore, neoprene is particularly durable and will retain its shape after being temporarily deformed during use, thereby providing equal cushioning each time the sock 100 or other hosiery garment is worn by the wearer 108.

The multi-layered cushion 110 still further includes a fabric layer 118 adhered to the synthetic rubber layer 116 on the top side. The fabric layer 118 is configured to be in contact with the foot of the wearer 108 during use. The fabric layer 118 may be made from a breathable polyester material that may be more comfortable against the skin of the wearer 108. Furthermore, the fabric layer 118 may share the same color as the sock 100 or other hosiery garment. For example, if the sock 100 or other hosiery garment was white, the fabric layer 118 may likewise be white. Alternately, in the case that the sock 100 or other hosiery garment was patterned, the fabric layer 118 may be similarly patterned. This may add to the aesthetic appeal of the sock 100 or other hosiery garment. The fabric layer 118 may further be configured prevent the rubber synthetic layer 116 from being worn away due to friction from the foot of the wearer 108. The fabric layer 118 may also be adhered to the rubber synthetic layer 116 by a heat pressing process. The heat pressing process may permanently adhere the fabric layer 118 to the synthetic layer 116 by briefly and slightly melting the rubber synthetic layer slightly such that the fabric layer 118 may be applied.

The three layers 112, 116, 118 of the multi-layered cushion 110 may have a combined thickness that is less than 0.25 inches. The thickness of the multi-layered cushion 110 should be such that it protects the Achilles heel of the wearer 108 while still retaining comfort and not restricting movement of the ankle of the wearer 108.

The multi-layered cushion 110 may have a pointed-elliptical shape, with both ends along the major horizontal axis of the multi-layered cushion 110 coming to a point, as shown particularly in FIGS. 8 and 10. As shown clearly in FIG. 10, each of the layers 112, 116, 118 may have the same profile. The multi-layered cushion 110 may have a horizontal width 120 that is about twice the length of the vertical height 122. It should be understood that the horizontal width 120 wraps about the axis of the ankle and leg of the wearer 108 while the vertical height 122 extends along the axis of the ankle and leg. The multi-layered cushion 110 may be applied such that it extends vertically from a corner seam 124 of the sock, as shown in FIG. 7. It should also be understood that the multi-layered cushion 110 may include similar dimensions to the cushion 20 described hereinabove.

A method of making the sock 100 or other hosiery garment is also contemplated by the present invention. The method may include first adhering the synthetic rubber layer 116 to an adhesive layer 112. The method may next include adhering the fabric layer 118 to the synthetic rubber layer 116 to create the multi-layer pad 110 having the synthetic rubber layer 116 located between the adhesive layer 112 and the fabric layer 118. The method may further include adhering the adhesive layer 112 to the inside 106 of the sock 100 or other hosiery garment that is adapted to enclose at least a foot of a wearer, such as the wearer 108. The inside 106 of the sock 100 or other hosiery garment is configured to be in contact with the foot of the wearer 108. Furthermore, the multi-layered cushion 110 wraps partially around the back side 111 of an ankle portion 113 of the sock 100 or other hosiery garment such that the multi-layered cushion 110 protects the Achilles heel of the wearer 108 from abrasion caused by a heel of footwear, such as the shoe 119.

The method of making the sock 100 or other hosiery garment may further include heat pressing the fabric layer 118 to the synthetic rubber layer 116. The method of making the sock 100 or other hosiery garment may further include die cutting the synthetic rubber layer 116 into an appropriate shape. The method may still further include peeling the protective layer 114 from the adhesive layer 112 prior to adhering the adhesive layer 112 to the inside 106 of the sock or other hosiery garment.

Furthermore, the method of making the sock 100 or other hosiery garment may further include determining the correct location to adhere the multi-layered cushion 110 to the sock 100 or other hosiery garment based on the exact size foot of a potential wearer of the shoe. For example, the sock 100 of the present invention may be particularly sized for use with soccer shoes and for a foot having a particular foot size (for example, a men's foot size of 9 in a U.S. sizing system) rather than a range of foot sizes (meaning, for example, for foot sizes ranging from 6-9 in a U.S. sizing system). Individualizing the sock 100 or other hosiery garment for a range of foot sizes and types of shoes may assure that the pad is in the correct location.

It should be understood that the above described method may be applied to hosiery garment such as dress socks, casual socks, stockings, legging, toe socks, tights, thigh-high socks, and athletic socks. Furthermore, the sock 100 or other hosiery garment may have a pad applied in the correct location for a variety of types of footwear such as dress shoes, casual shoes, high heeled shoes, boots, sneakers, tennis shoes, orthopedic shoes, basketball shoes, running shoes, ice skates, athletic cleats, ski boots, cross trainer shoes, sandals, and flats.

Furthermore, the above described method may be completed with a computerized machine assembly process. For example, the multi-layered cushion 110 may be assembled with a first automated assembly line and then applied to a sock with a second automated assembly line. Alternately, a single automated assembly line may perform the above described method. In another embodiment, many of the steps of the method are performed by hand. For example, the sock 100 may be put on a mannequin in an inside-out configuration so that the inside 106 is exposed. The mannequin may have a foot of a particular size (such as a men's foot size of 9 in a U.S. sizing system) and a human may peel the peelable protective layer from the multi-layered cushion 110 and adhere the cushion to the sock 100.

Elements of the embodiments have been introduced with either the articles "a" or "an." The articles are intended to mean that there are one or more of the elements. The terms "including" and "having" and their derivatives are intended to be inclusive such that there may be additional elements other than the elements listed. The conjunction "or" when used with a list of at least two terms is intended to mean any term or combination of terms. The terms "first" and "second" are used to distinguish elements and are not used to denote a particular order.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

We claim:

1. A hosiery garment comprising:

a main body adapted to enclose at least a foot of a wearer, the main body having an outside and an inside, wherein the inside is configured to be in contact with the foot of the wearer; and a multi-layered cushion, the multi-layered cushion comprising:

an adhesive layer permanently adhering the multi-layered cushion to the inside of the main body;

a synthetic rubber layer adhered to the adhesive layer; and a fabric layer adhered to the synthetic rubber layer and configured to be in contact with the foot of the wearer;

wherein the multi-layered cushion wraps partially around a back side of an ankle portion of the hosiery garment such that the multi-layered cushion protects an Achilles heel of the wearer from abrasion caused by a heel of a footwear, and wherein the multi-layered cushion is designed to extend over a portion of a shoe line of the footwear on the ankle portion of the hosiery garment.

2. The hosiery garment of claim 1, wherein the adhesive layer is made from a highly adhesive transfer tape having a temperature resistance of at least 200 degrees Fahrenheit.

3. The hosiery garment of claim 2, wherein the adhesive layer includes a peelable protective layer prior to being adhered to the inside of the main body of the hosiery garment.

4. The hosiery garment of claim 1, wherein the synthetic rubber layer is made of neoprene having a temperature resistance of at least 200 degrees Fahrenheit.

5. The hosiery garment of claim 1, wherein the fabric layer is made from a breathable polyester material.

6. The hosiery garment of claim 1, wherein the fabric layer shares the same color as the hosiery garment.

7. The hosiery garment of claim 1, wherein the fabric layer is adhered to the neoprene by a heat pressing process.

8. The hosiery garment of claim 1, wherein the thickness of the multi-layered cushion is less than .25 inches.

9. The hosiery garment of claim 1, wherein the garment is a sock and wherein the footwear is an athletic cleat.

10. The hosiery garment of claim 1, wherein the hosiery garment is a garment selected from the group consisting of dress socks, casual socks, stockings, legging, toe socks, tights, thigh-high socks, and athletic socks.

11. The hosiery garment of claim 1, wherein the footwear is selected from the group consisting of dress shoes, casual shoes, high heeled shoes, boots, sneakers, tennis shoes, orthopedic shoes, basketball shoes, running shoes, ice skates, athletic cleats, ski boots, cross trainer shoes, sandals, and flats.

12. The hosiery garment of claim 1, wherein the multi-layered cushion has a horizontal width that is about twice the length of a vertical height.

13. A hosiery garment comprising:

a multi-layered cushion, the multi-layered cushion comprising:

an adhesive transfer tape layer permanently adhering the multi-layered cushion to the interior surface of the hosiery garment;

a neoprene layer adhered to the adhesive layer; and a breathable polyester fabric layer adhered to the synthetic rubber layer and configured to be in contact with the foot of the wearer;

wherein the multi-layered cushion wraps partially around a back side of an ankle portion of the interior surface of the hosiery garment such that the multi-layered cushion protects an Achilles heel of the wearer from abrasion caused by a heel of a footwear, and wherein the multi-layered cushion is designed to extend over a portion of a shoe line of the footwear on the ankle portion of the hosiery garment.

14. The hosiery garment of claim 1, wherein the multi-layered cushion extends beyond a top of the heel of the footwear.

15. The hosiery garment of claim 13, wherein the multi-layered cushion extends beyond a top of the heel of the footwear.

* * * * *